US005590815A

United States Patent [19]

Montaner et al.

[11] Patent Number: 5,590,815

[45] Date of Patent: Jan. 7, 1997

[54] MINATURE PUMP SPRAYER

[75] Inventors: Pedro P. Montaner; Manuel R. Monegal, both of Barcelona, Spain; Ron E. Harriman, Montebello, Calif.; P. Lasserre, Coubron, France

[73] Assignee: Monturas S.A., Barcelona, Spain

[21] Appl. No.: 502,177

[22] Filed: Jul. 13, 1995

[51] Int. Cl.[6] ..... B67D 5/42

[52] U.S. Cl. ..... 222/82; 222/153.06; 222/321.1; 222/321.7

[58] Field of Search ..... 222/82, 153.01, 222/153.06, 341, 321.1, 321.2, 321.7, 321.9, 382, 383.1, 385; 239/333

[56] References Cited

U.S. PATENT DOCUMENTS

| | | | |
|---|---|---|---|
| 3,040,991 | 6/1962 | Fedit . | |
| 3,820,698 | 6/1974 | Franz . | |
| 4,369,900 | 1/1983 | Saito et al. | 111/321.1 |
| 4,538,745 | 9/1985 | Dunning . | |
| 4,693,675 | 9/1987 | Venus, Jr. . | |
| 4,767,058 | 8/1988 | LaRosa . | |
| 4,775,080 | 10/1988 | Mettenbrink . | |
| 4,911,336 | 3/1990 | Blake . | |
| 5,242,089 | 9/1993 | Knickerbocker . | |

FOREIGN PATENT DOCUMENTS

| | | | |
|---|---|---|---|
| 0000313 | 1/1979 | European Pat. Off. | 222/321.2 |
| 2522283 | 9/1983 | France | 222/321.9 |
| 828160 | 2/1960 | United Kingdom | 222/82 |
| WO89/01365 | 2/1989 | WIPO . | |

*Primary Examiner*—Andres Kashnikow
*Assistant Examiner*—Kenneth Bomberg
*Attorney, Agent, or Firm*—Watson Cole Stevens Davis, P.L.L.C.

[57] ABSTRACT

A ventless miniature pump sprayer comprises a reciprocable plunger head extending outwardly of an open end of a tubular member divided into an upper sleeve section and a lower container section for a liquid to be sprayed. A dip tube integral with the member extends into the container, and a pump cylinder and hollow inlet tube integral with tie member extend into the sleeve section. An integral shipper seal is molded in the inlet tube and a coaxial rod within a hollow piston on the plunger cooperates with the inlet tube for controlling the inlet and, during initial actuation of the plunger, pierces the shipper seal and has a groove or a rib thereon which establishes an air passage through which unwanted air from the pump chamber is ejected into the container to aid in pump priming.

17 Claims, 1 Drawing Sheet

MINATURE PUMP SPRAYER

BACKGROUND OF THE INVENTION

This invention relates generally to a fingertip actuated ventless pump sprayer of simple design having a reduced number of parts adapted for spraying small amounts of liquid product such as samples and/or concentrates of, for example, perfumes and colognes from a container formed as an integral part of a tubular member to which a reciprocable plunger head is mounted.

More particularly, the plunger head extends from one open end of the tubular member, a filling plug closing the opposite open end of the tubular member, and the dip tube, pump cylinder, and a hollow tube defining an inlet passage all being integral with the tubular member. And, the miniature pump sprayer has a frangible shipper seal which is punctured upon initial actuation of the plunger head by a depending probe on the head permitting unwanted air to be dumped from the pump chamber into the container to aid in priming.

The present invention is an improvement over U.S. Pat. No. 5,242,089 disclosing a miniature pump sprayer having a pump cylinder and integral dip tube mounted as a unit within the upper open end of a vial comprising a container of liquid product to be dispensed. The plunger skirt engages a flange on the cylinder and has a coaxial rod which plugs into a hollow tube forming the inlet for valving the inlet closed during each pressure stroke of the plunger.

The vial to which the pump cylinder is attached must be filled prior to assembly which complicates the production and assembly operation, and the separate cylinder and vial parts increases the cost of assembly and production while detracting from the overall streamlined appearance of the package.

Moreover, during shipping and storage this prior art pump sprayer could leak product out of the discharge orifice if the plunger head were inadvertently bumped or nudged causing plunger depression.

Still further, the prior art miniature pump sprayer expels unwanted air from the pump chamber through the discharge orifice upon initial pump actuation for priming the chamber with product during each suction stroke. This oftentimes requires more plunger strokes than desirable to effect priming.

SUMMARY OF THE INVENTION

It is therefore an object of the present invention to provide a ventless fingertip pump sprayer wherein the reciprocable plunger extends outwardly of an open end of a one-piece molded tubular member which includes a liquid product compartment containing product to be dispensed, the pump cylinder, dip tube and hollow inlet tube. The opposite open end of the tubular member is closed by a filling plug after the container is filled with product.

A frangible shipper seal located in the inlet tube is pierced by a depending solid probe on the plunger during initial actuation. At or near the end of the initial downstroke, a rib and/or groove on the probe establishes an air passage into the container through the dip tube through which unwanted air is ejected to aid in priming the pump chamber with liquid product on the ensuing upstroke. And, because the integrally molded dip tube must be maintained at a given size to facilitate the integral molding of the shipper seal, the large volume created for the liquid product in the dip tube may be undesirable but is remedied by the provision of an elongated tube insert fixed within the dip tube to reduce the liquid holding volume of the dip tube.

Other objects, advantages and normal features of the invention will become more apparent from the following detailed description of the invention when taken in conjunction with the accompanying drawings.

DETAILED DESCRIPTION OF THE INVENTION

Figure 1:
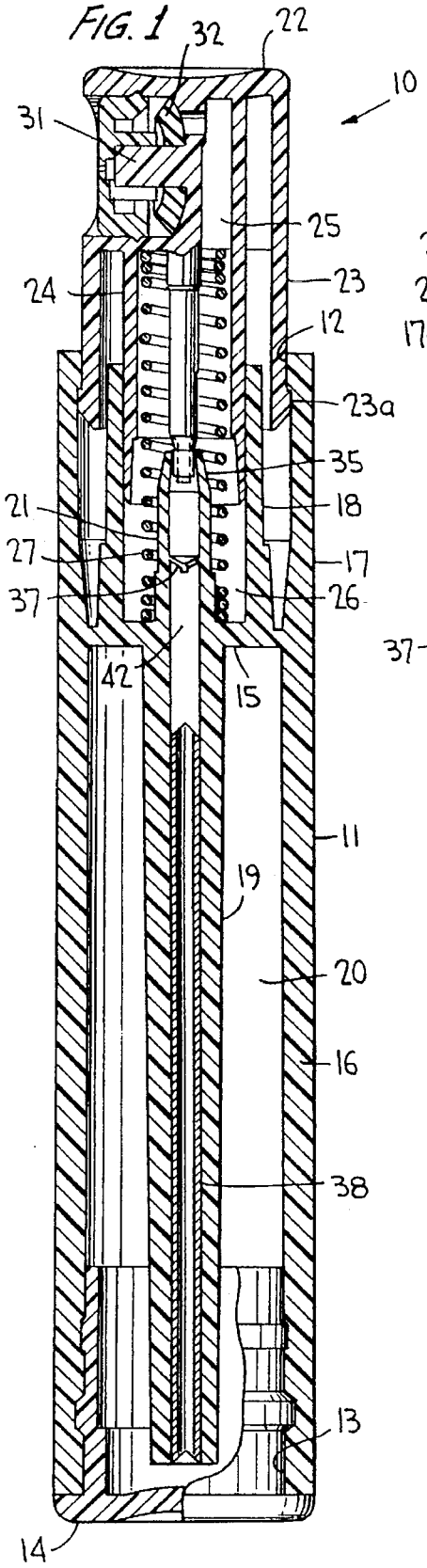
FIG. 1 is a vertical sectional view of the pump sprayer according to the invention shown in the inactive position of the plunger before pump priming.
Figure 2:
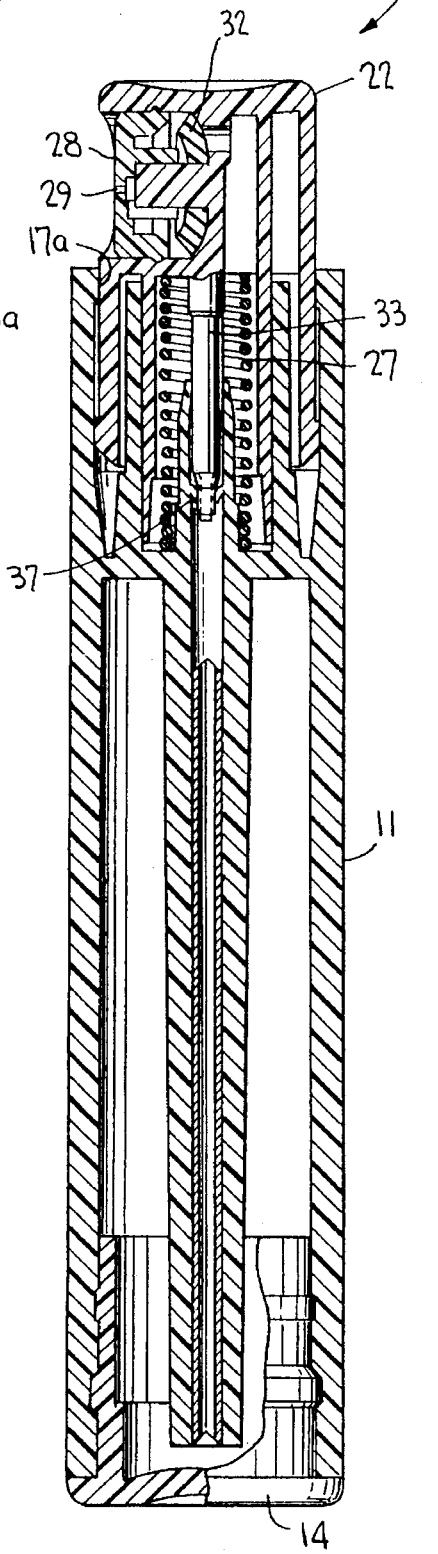
FIG. 2 is a view similar to FIG. 1 showing the plunger depressed on initial actuation for priming the pump chamber.

Turning now to the drawings wherein like reference characters refer to like and corresponding parts throughout the several views, the pump sprayer of the invention is generally designated 10 in FIGS. 1 and 2 as comprising a tubular member 11 having an open upper end 12 and an open lower end 13 closed by a filling plug 14. Member 11 has an integral transverse wall 15 defining together with plug 14 a container section 16 enclosing a compartment 20 filled with liquid product to be sprayed upon plug removal and replacement. That portion of the tubular member upwardly of wall 15 defines a sleeve 17 surrounding a pump cylinder 18 in spaced relation, the pump cylinder being integral with transverse wall 15.

An integral dip tube 19 extends from wall 15 into the container, and an integral hollow inlet tube 21 extends from wall 15 into cylinder 18.

A pump plunger head 22 extends outwardly of open end 12, its plunger skirt 23 being slidable along the inner face of sleeve 17. The plunger has a hollow pump piston 24 defining a discharge passage 25, the piston sealingly engaging the pump cylinder for reciprocation between pressure and suction strokes and defining a variable volume pump chamber 26 with the cylinder.

A piston return spring 27 extends between the plunger and wall 15 for biasing the plunger head to its FIG. 1 position. Skirt 23 has an external flange 23*a* engaging an internal flange 17*a* on sleeve 17 to define limit stops for limiting the outward extent of the plunger head.

Similarly as described in U.S. Pat. No. 5,242,089, the plunger head supports a nozzle cup 28 having a discharge orifice 29, the cup surrounding a discharge probe 31 and containing the necessary spin mechanics for breaking up the liquid passing through discharge valve 32 to effect a fine mist spray.

Figure 3:
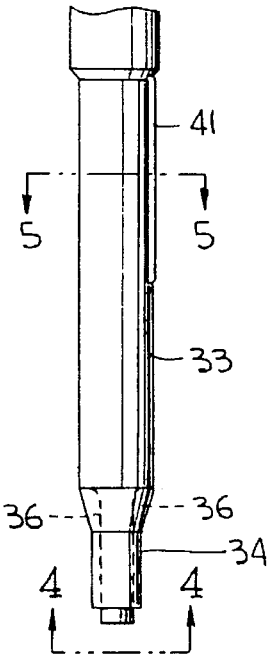
FIG. 3 is an enlarge side elevational view of the hollow probe depending from the plunger.

A solid rod or probe 33 depends from the plunger head concentric with the piston. Lower end 34 (FIG. 3) of the probe extends into the constricted upper free end 35 of hollow inlet tube 21 and is thereby guided during plunger actuation. Lower end 34 is irregularly shaped, and, for example, may have a pair of opposing short axial grooves 36

Figure 4:
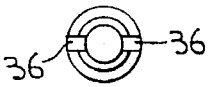
FIG. 4 is a view taken substantially along the line 4—4 of FIG. 3.

(FIG. 4) which, as will be explained in more detail hereinafter, function to establish openings at the end of each suction stroke to ensure inletting of liquid product into pump chamber 26.

Hollow inlet tube 21 has an integral and frangible shipper seal 37 spaced from the upper end of tube 21 a distance permitting the seal to be punctured during the initial downward stroke of the plunger, as shown in FIG. 2.

The inner diameter of the inlet tube 21 and the inner diameter of dip tube 19 are of substantially equal size to facilitate the molding of seal 37 which may be in the form of a membrane. To enhance priming, the inner diameter of the dip tube should be of a reduced size than permitted by the molding operation. The molded given size of the dip tube could introduce a problem because there is too much volume, which holds too much liquid. Thus, an elongated tube insert 38 is fixed within the dip tube for reducing its inner diameter and thereby the volume held by the dip tube, to thereby enhance priming.

Figure 5:
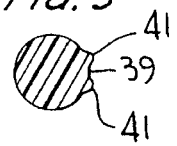
FIG. 5 is a sectional view taken substantially along the line 5—5 of FIG. 3.

In operation, the pump must be first primed to expel unwanted air from pump chamber 26 to replace the expelled air with liquid from the container. For this purpose, probe 33 has at least one axial groove 39 (FIG. 5) along its upper end which may be formed by the provision of a pair of spaced ribs 41. Thus, in the inactive position of the pump during shipping and storage, seal 37 seals inlet passage 42 closed against possible leakage from the container upon any slight depression of the plunger head upon nudging or bumping which could otherwise cause leakage through the discharge orifice.

To prime the pump, the plunger head is manually depressed such that during the downstroke that portion of probe 33 between its lower end 34 and the groove/ribs 34, 41 plugs into tube 21 into sealing engagement for valving the inlet closed. Upon continued downstroke movement to the FIG. 2 position, lower end 34 of probe 33 breaks seal 37 by puncturing it, and grooves 36 at lower end 34 ensure the formation of air openings through the punctured seal. The outer major diameter of probe 33 is slightly less than the major inner diameter of tube 21, thereby establishing an annular gap, except that during the downward movement of the plunger head, probe 33 seals the inlet closed upon sealing engagement with upper constricted end 35 of hollow tube 21. During the continued downward movement of the plunger head, the sealing engagement between probe 33 and constricted end 35 is broken by groove 39 and ribs 41 thereby establishing communication between the pump chamber and the container via punctured seal 37 and the dip tube. Thus, during downward movement of the plunger head to its FIG. 2 position, the unwanted air in the pump chamber is pressurized and is expelled into the container to assist in priming the pump as liquid from the container is boosted by the expelled air and forced up the dip tube and into the pump chamber during the ensuing suction stroke. The plunger head may need to be actuated a second or third time to completely expel the air from the chamber and replace it with liquid as aforedescribed.

Once the pump chamber is fully primed, short strokes of the plunger head are typically required for discharging product as a fine mist spray during each pressure stroke at which the inlet is sealed closed as probe 33 seals into inlet tube 21. During each ensuing suction stroke product is suctioned into the pump chamber via the punctured seal 37 and grooves 36 due to the differential in pressure between atmospheric in the container and subatmospheric in the pump chamber. The pumping operation is the same as that described in the U.S. Pat. No. 5,242,089.

Once seal 37 is punctured, the opening thereby created presents no obstacle in permitted liquid product to be drawn up the dip tube to refill the pump chamber during each suction stroke, as in any normal pump operation.

The sprayer according to the invention may be used as a miniature sampler containing products such as perfume or cologne in such small volume as to be emptied after but a few strokes. Hence, there is no need for container venting and the one piece molded construction of tubular member 11 may be of rigid plastic material to withstand any container collapse during dispensing. Member 11 can be easily molded as one piece, including membrane 37, and the container can be filled with liquid product upon removal and replacement of plug 14. Tube insert 38 reduces the volume of liquid product held by the dip tube to thereby enhance priming as a reduced volume of liquid is required to be suctioned up through the dip tube during each suction stroke.

The sprayer package according to the invention is streamlined for attractive appearance, has few moving parts and a reduced number of parts.

Terms of orientation such as "upper" and "lower" and the like, are used herein for purposes of clarity to identify the orientation relative to the drawings. Such terms are not intended to limit the scope of this invention or to exclude any equivalent structure.

Many modifications and variations of the present invention are made possible in the light of the above teachings. For example, groove 39 and ribs 41 on probe 33 can be replaced by equivalent seal breaking means such as a roughened or otherwise grooved surface of the probe, without departing from the invention. And, grooves 36 at lower end 34 of probe 33 can be eliminated as not essential to the invention. End 34 can be of reduced size having some other irregular shape, or may be conical or pointed, for example. It is therefore to be understood that within the scope of the appended claims, the invention may be practiced otherwise than as specifically described.

What is claimed is:

1. A ventless fingertip pump sprayer, comprising, a container of liquid product to be dispensed, a pump cylinder supporting a dip tube extending into said container, said cylinder and said dip tube being integrally formed with said container, a plunger head having a hollow piston in sliding sealing engagement with said cylinder for reciprocation between pressure and suction strokes, said piston and said cylinder defining a variable volume pump chamber, spring return means acting between said cylinder and said plunger head, said plunger head having a discharge passage including said hollow piston and terminating in a discharge spray means mounted on said head, an upstanding hollow tube formed integrally with said dip tube and extending into said cylinder for defining an inlet passage, a solid probe formed integrally with said head for sealingly engaging an upper inner end of said tube for valving said inlet passage closed upon initiation of each pressure stroke, a frangible shipper seal formed integrally within said hollow tube for sealing said inlet passage closed against leakage prior to initial actuation of said plunger head, said probe piercing through said shipper seal on the initial actuation of said plunger head for unsealing said inlet passage, and means on said probe for breaking said sealing engagement with said upper inner end of said tube during a continued pressure stroke upon said initial actuation to define an air passage through which unwanted air in said pump chamber is ejected under pressure into said container to assist in priming said pump chamber with the liquid product.

2. The pump sprayer according to claim 1, wherein a sleeve formed integrally with said container surrounds said cylinder in spaced relation, said plunger head having a skirt in sliding engagement with said sleeve, said skirt and said sleeve having cooperating limit stops for limiting an outward extent of said plunger head from said cylinder.

3. The pump sprayer according to claim 1, wherein said means for breaking said sealing engagement comprises an axial groove.

4. The pump sprayer according to claim 1, wherein said means for breaking said sealing engagement comprises at least one axial rib.

5. The pump sprayer according to claim 1, wherein said container has an open bottom end closed by a filling plug.

6. The pump sprayer according to claim 1, wherein said dip tube and said tube have a constant inner diameter, said upper inner end of said tube having a constricted inner diameter relative to said constant diameter, an elongated tube insert being fixed within said dip tube to reduce, as an aid in priming, the volume of liquid product suctioned into said pump chamber during said suction strokes.

7. The pump sprayer according to claim 1, wherein said probe has an irregularly shaped free end defining openings with said upper inner end of said tube at the end of said suction strokes to ensure inletting of liquid product into said chamber, said irregularly shaped free end further ensuring the passage of ejected air through the pierced shipper seal.

8. The pump sprayer according to claim 2, wherein said sleeve and said container have substantially the same outer diameter such that said sleeve forms a smooth extension of said cylinder, said limit stops being provided internally of said sleeve and externally of said plunger head skirt.

9. A ventless fingertip pump sprayer, comprising, a tubular member having open upper and lower ends and an internal, integral transverse wall between said ends, a filling plug closing said lower end, said member defining between said plug and said transverse wall a container section enclosing a compartment of liquid product to be sprayed, an integral pump cylinder within said member extending from said wall toward said upper end, said wall supporting an integral dip tube extending into said container section, a reciprocable plunger head having a discharge passage mounted on said member for actuation between pressure and suction strokes, a piston fixed to said head for sliding sealing engagement with said cylinder defining therewith a variable volume pump chamber, spring return means acting between said plunger head and said wall, an integral hollow tube defining an inlet passage extending into said cylinder from said wall, an integral solid probe on said head sealingly engaging the interior of said tube during said pressure strokes for valving said inlet passage closed upon initiation of each pressure stroke, shipper seal means formed integrally within said tube for sealing said inlet passage closed prior to actuation of said head, said probe unsealing said seal means upon the initial actuation of said plunger head, and means on said probe for breaking the sealing engagement with said tube to establish an air passage through which unwanted air from said pump chamber is ejected into said container to assist in priming said pump chamber with liquid product.

10. The pump sprayer according to claim 9, wherein said plunger head extends outwardly of said upper end and has a skirt in sliding engagement with said tubular member, said skirt and said member having cooperating limit stops for limiting the outward extent of said plunger head.

11. The pump sprayer according to claim 9, wherein said shipper seal means comprises a frangible membrane.

12. The pump sprayer according to claim 9, wherein said means for breaking the sealing engagement comprises an axial groove.

13. The pump sprayer according to claim 9, wherein said means for breaking the sealing engagement comprises at least one axial rib.

14. The pump sprayer according to claim 9, wherein said hollow tube and said dip tube have a substantially constant inner diameter, an upper end of said tube having a constricted inner diameter relative to said constant diameter.

15. The pump sprayer according to claim 14, further comprising an elongated tube insert fixed within said dip tube which functions as an aid in priming by reducing the volume of liquid product in said dip tube suctioned into said pump chamber during said suction strokes.

16. The pump sprayer according to claim 9, wherein said probe has an irregularly shaped free end to establish an opening with said hollow tube at the end of said suction strokes to ensure inletting of liquid product into said chamber.

17. The pump sprayer according to claim 14, wherein said probe has an irregularly shaped free end to establish an opening with said constricted inner diameter of said hollow tube at the end of the suction strokes to ensure inletting of liquid product into said chamber.

* * * * *